US011230839B2

(12) United States Patent
Klein et al.

(10) Patent No.: US 11,230,839 B2
(45) Date of Patent: Jan. 25, 2022

(54) THERMAL AND ACOUSTIC INSULATING AND SEALING SYSTEM FOR FLUTED DECK CONSTRUCTIONS

(71) Applicant: Hilti Aktiengesellschaft, Schaan (LI)

(72) Inventors: Manfred Klein, Kaufering (DE); Christian Förg, Lamerdingen (DE)

(73) Assignee: Hilti Aktiengesellschaft, Schaan (LI)

( * ) Notice: Subject to any disclaimer, the term of this patent is extended or adjusted under 35 U.S.C. 154(b) by 343 days.

(21) Appl. No.: 16/332,401

(22) PCT Filed: Sep. 11, 2017

(86) PCT No.: PCT/EP2017/072694
§ 371 (c)(1),
(2) Date: Mar. 12, 2019

(87) PCT Pub. No.: WO2018/050581
PCT Pub. Date: Mar. 22, 2018

(65) Prior Publication Data

US 2021/0189721 A1 Jun. 24, 2021

(30) Foreign Application Priority Data

Sep. 14, 2016 (EP) ..... 16188705

(51) Int. Cl.
*E04B 2/74* (2006.01)
*E04B 2/00* (2006.01)

(52) U.S. Cl.
CPC ..... *E04B 2/7411* (2013.01); *E04B 2/7457* (2013.01)

(58) Field of Classification Search
CPC ..... E04B 2/7411; E04B 2/7457
(Continued)

(56) References Cited

U.S. PATENT DOCUMENTS 3,913,292 A * 10/1975 Braekkan ..... E04B 2/825 52/406.1
4,021,982 A * 5/1977 Kotcharian ..... F16L 59/02 52/410

(Continued)

FOREIGN PATENT DOCUMENTS

CA 2 886 550 9/2015
WO 2009/026464 2/2009

OTHER PUBLICATIONS

International Search Report dated Sep. 27, 2017 in PCT/EP2017/072694.
Written Opinion dated Sep. 27, 2017 in PCT/EP2017/072684

*Primary Examiner* — Brian D Mattei
*Assistant Examiner* — Joseph J. Sadlon
(74) *Attorney, Agent, or Firm* — Grüneberg and Myers PLLC

(57) ABSTRACT

Described is a construction and parts of the construction for effectively thermally and acoustically insulating and sealing of a head of wall joint within a building construction having a metal deck construction defined by a head of a wall and a metal fluted deck comprising one or more flutes, wherein the head of wall is defined by a head of wall track including vertical studs and a dry wall affixed thereto, and wherein the head of wall track is installed parallel to the flute to the underside of the metal fluted deck defining a head of wall joint extending between the top edge of the dry wall and the underside of the metal fluted deck.

20 Claims, 7 Drawing Sheets

(58) Field of Classification Search
USPC ..... 52/479
See application file for complete search history.

(56) References Cited

U.S. PATENT DOCUMENTS 4,057,123 A * 11/1977 Erickson ..... E04B 1/8227 181/286
4,179,858 A * 12/1979 Graham ..... E04B 1/76 52/223.7
4,283,449 A * 8/1981 Damminger ..... B32B 3/28 428/218
4,723,385 A * 2/1988 Kallstrom ..... E04B 1/942 52/232
4,866,898 A * 9/1989 LaRoche ..... E04B 1/6804 52/396.01
5,448,863 A * 9/1995 Zapf ..... E04B 2/7422 160/395
5,913,788 A * 6/1999 Herren ..... E04B 2/7457 52/241
6,061,995 A * 5/2000 Menchetti ..... E04C 3/29 52/794.1
6,068,907 A * 5/2000 Beauregard ..... B32B 5/28 428/71
6,141,926 A * 11/2000 Rossiter ..... E04B 2/7425 160/135
6,216,404 B1 * 4/2001 Vellrath ..... E04B 2/7411 52/1
6,783,345 B2 * 8/2004 Morgan ..... F16L 5/04 425/110
7,497,056 B2 * 3/2009 Surowiecki ..... E04B 2/7457 52/261
8,397,453 B2 * 3/2013 Shaw ..... E04B 1/948 52/232
8,468,759 B2 * 6/2013 Klein ..... E04B 1/94 52/241
8,474,386 B2 * 7/2013 DelloRusso, Jr. ..... E05G 1/024 109/80
8,499,512 B2 * 8/2013 Pilz ..... E04B 1/24 52/235
8,601,760 B2 * 12/2013 Hilburn, Jr. ..... E04B 1/947 52/232
8,813,450 B1 * 8/2014 Hensley ..... E04B 1/94 52/396.01
10,495,129 B2 * 12/2019 Thomas ..... F16B 43/001
2006/0070321 A1 * 4/2006 Au ..... C04B 28/26 52/232
2009/0223159 A1 * 9/2009 Colon ..... E04B 2/7409 52/404.1
2011/0185656 A1 8/2011 Klein
2018/0195282 A1 * 7/2018 Pilz ..... E04B 2/02

* cited by examiner

THERMAL AND ACOUSTIC INSULATING AND SEALING SYSTEM FOR FLUTED DECK CONSTRUCTIONS

This application is a National Stage entry under § 371 of International Application No. PCT/EP2017/072694, filed on Sep. 11, 2017, and claims priority to European Patent Application No. 16188705.4, filed on Sep. 14, 2016, the entire contents of which are hereby incorporated by reference.

FIELD OF THE INVENTION

The present invention relates to the field of constructions, assemblies and systems designed to thermally and acoustically insulate and seal a gap defined between a head of a wall and a metal fluted deck. In particular, the present invention relates to a fire, smoke and sound-resistant insulating and sealing element for use in a metal deck construction defined by a head of a wall and a metal fluted deck comprising one or more flutes, wherein the head of wall is defined by a head of wall track including vertical studs for affixing a dry wall thereto, and wherein the head of wall track is installed parallel to the flute to an underside of the metal fluted deck. Maintaining of a complete thermal insulation and seal at all time during a fire is important to prevent heat, smoke and flames from spreading from one building compartment to the other via the flutes and head of wall area comprised in a metal fluted deck.

BACKGROUND OF THE INVENTION

In contemporary building constructions, formworks formed of corrugated sheet metal that consist of alternating valley and peak regions, found a wide application. Primarily, such formworks are used in substantially horizontal ceilings and are cast in concrete on the site. They are also often found in floors and walls. The corrugated sheet metal remains on the lower side of the ceiling.

In order to install and insulate a dry wall construction within a fluted metal deck construction, a ceiling runner, which has normally a U-shape, is usually fixed on the bottom side, also referred to as underside, of a fluted metal deck. The dry wall gypsum boards are fixed on the vertical studs located on the ceiling runner, leaving a defined joint between top edge of the wall, so called head of wall, and the fluted metal deck. This joint and also the flutes of the metal deck are usually filled with mineral wool and coated with an elastic material, generally an acrylic or silicone spray, to seal against fire, smoke and acoustics.

There are different ways to install the dry wall to the bottom side of a fluted metal deck. In about half of the cases the dry wall is positioned perpendicular to the metal deck flute direction. The other half is represented by the installation of the dry wall positioned parallel to the flute direction. In the latter case and in order to gain a fire-rating, the dry wall is positioned directly below and parallel to a flute of the metal deck, the relevant flute is filled with mineral wool, generally by using preformed mineral wool plugs having the shape of the flutes. To keep the mineral wool plugs in place and also to create the possibility of fixing the ceiling runner of the dry wall, thin metal straps are fixed perpendicular to the flutes to the underside of the fluted metal deck thereby creating a flat surface for fixing the ceiling runner to the deck. The dry wall gypsum boards are fixed on the vertical studs located on the ceiling runner, leaving a defined joint between top edge of the wall and the fluted metal deck. Moreover, the joint between the top edge of the dry wall gypsum board and the ceiling must be filled with mineral wool. The joint, in particular the flute of the metal deck is also filled with mineral wool, and then insulated area is coated with an elastic material, generally an acrylic or silicone spray, to seal against fire, smoke and acoustics. This joint is needed to compensate dimensional tolerances of the fluted metal deck and to allow movement between the deck and the wall caused by load or temperature.

Therefore, it is of great importance to improve fire stopping in and at the joint in order to keep heat, smoke and flames from spreading from one building compartment to another. Further it is of importance to create an acoustic seal.

Various designs have been known for fluted metal deck constructions and for means for thermally as well as acoustically insulating and sealing the joint in such a metal deck construction, wherein the dry wall is positioned and installed parallel to the flute direction. WO 2009/026464 A2 teaches to use a continuous length of a steel flat strap including an intumescent strip resting between the flat strap and the valley region on the underside of the fluted metal deck, but not within the flute. US 2011/0185656 A1 discloses a fire retardant cover having a corrugated shape which makes installation of a dry wall below a flute difficult, especially if the dry wall is only partially positioned in the central region of the flute. Current solutions provide sealing using pre-compressed mineral wool covered by an elastic coating.

All these solutions have several drawbacks, such as that the installation of a highly pre-compressed mineral wool is labor intensive and not failure proof. The interface between the peak valley of the flute and the head of the wall is the weak point of the insulating system which is not sufficiently addressed by the current solutions. Further, additional and expensive equipment is needed to install the essential fire-stop spray coating. Often the installation process is weather dependent, the mineral wool can absorb water and the coating needs a certain drying time. Also, mineral wool is known to cause skin irritations. Usually, several working steps are needed to insulate and secure fire-resistance of the joint system as first the mineral wool needs to be filled into the flute and then sealing of the flute and joint must be performed separately. The spray coating cannot be applied before the dry wall gypsum boards are in place and spraying from both sides becomes more time-consuming and costly. Another disadvantage of the prior art is that the user is in charge of filling in enough insulating material and applying enough coating material to secure fire-resistance and sealing. Moreover, adaptation and cutting of the metal cover plates is time-consuming and labor-intensive. The thermal insulation of the metal plates used in the prior art systems may be insufficient, so that the heat transfer could cause a self-ignition on the cold side. When used for acoustic insulation a disadvantage is that the sound properties of a thin metal plate are limited, and hence leading to insufficient acoustic insulation. Finally, in case of uneven surfaces (e.g. pollution with fire resistant cementitious spray coating) tightening of metal to metal is difficult, in particular tightening the metal plate to the deck as well as the ceiling runner thereto.

Therefore, there is a need for systems that overcome the disadvantages of the prior art systems. In particular, there is a need for systems that can be fast, failure-proof and easily installed within a head of wall area in a fluted metal deck construction defined by a head of a wall and a metal fluted deck comprising one or more flutes, wherein the head of wall is defined by a head of wall track including vertical studs for affixing a dry wall thereto, and wherein the head of wall track is installed parallel to the flute to an underside of the metal fluted deck. Further, there is a need for systems that are not limited to the geometric design and the height of the flute of a corrugated metal deck construction thereby compensating at the same time dimensional tolerances of the fluted metal deck and to allow movement between the deck and the wall caused by load or temperature. Additionally, maintaining safing insulation in the head of wall area between building compartments including a fluted metal deck construction responsive to various conditions including fire exposure should be guaranteed. Moreover, there is a need for systems that improve fire-resistance as well as sound-resistance and that can be easily integrated during installation of the metal deck construction.

In view of the above, it is an object of the present invention to provide a fire-resistant insulating and sealing element for use in a metal deck construction, that can be fast, failure-proof and easily installed within a head of wall area in a fluted metal deck construction defined by a head of a wall and a metal fluted deck comprising one or more flutes, wherein the head of wall is defined by a head of wall track including vertical studs for affixing a dry wall thereto, and wherein the head of wall track is installed parallel to the flute to an underside of the metal fluted deck.

In particular, it is an object of the present invention to provide a thermal insulating and sealing system which maintains the safing insulation between the head of wall area between building compartments including a fluted metal deck construction responsive to various conditions, including fire exposure, and to maximize safing insulation at a minimal cost. Moreover, it is an object to provide a thermal insulating and sealing system which has no limitation of vertical as well as horizontal movement capacities, limitation to flute height as well as the ability to compensate dimensional tolerances of the fluted metal deck and to allow movement between the deck and the wall caused by load or temperature.

Further, it is an object of the present invention to provide a fluted roof deck comprising a fire and sound-resistant insulating and sealing element for covering at least one of the flutes comprised in a metal fluted deck, to create a flat surface for installation of a head of wall track to the underside of the metal fluted deck enabling installation of the ceiling runner at any position on the underside of the deck parallel to the flute.

Still further, it is an object of the present invention to provide a building construction comprising such a fire-resistant insulating and sealing element or such a thermal insulating and sealing system, respectively, for effectively thermally insulating and sealing the head of wall area defined by a head of wall track installed parallel to the flute to an underside of a metal fluted deck.

Still further, it is an object to provide at the same time an acoustic insulating and sealing system for effectively acoustically insulating and sealing the head of wall area defined by a head of wall track installed parallel to the flute to an underside of a metal fluted deck.

These and other objectives as they will become apparent from the ensuring description of the invention are solved by the present invention as described in the independent claims. The dependent claims pertain to preferred embodiments.

SUMMARY OF THE INVENTION

In one aspect, the present invention provides a fire-resistant insulating and sealing element for use in a metal deck construction defined by a head of a wall and a metal fluted deck comprising one or more flutes, wherein the head of wall is defined by a head of wall track including vertical studs for affixing a dry wall thereto, and wherein the head of wall track is installed parallel to the flute to an underside of the metal fluted deck, characterized in that the fire-resistant insulating and sealing element comprises at least one layer of a cover material and at least one layer of an insulating material.

In another aspect, the present invention provides a thermal insulating and sealing system for effectively thermally insulating and sealing of a head of wall joint within a building construction having a metal deck construction defined by a head of a wall and a metal fluted deck comprising one or more flutes, wherein the head of wall is defined by a head of wall track including vertical studs and a dry wall affixed thereto, and wherein the head of wall track is installed parallel to the flute to the underside of the metal fluted deck defining a head of wall joint extending between the top edge of the dry wall and the underside of the metal fluted deck, comprising a fire-resistant insulating and sealing element having at least one layer of a cover material, optionally at least one layer of a strengthening material, and at least one layer of an insulating material, wherein the at least one layer of a cover material is positioned in abutment with respect to the underside of the metal fluted deck spanning across the entire flute to create a flat surface for installation of a head of wall track to the underside of the metal fluted deck.

In yet another aspect, the present invention provides a fluted roof deck comprising a fire-resistant insulating and sealing element for covering at least one of the flutes comprised in a metal fluted deck to create a flat surface for installation of a head of wall track to the underside of the metal fluted deck, wherein the fire-resistant insulating and sealing element having at least one layer of a cover material, optionally at least one layer of a strengthening material, and at least one layer of an insulating material, is positioned in abutment with respect to the underside of the metal fluted deck spanning across the entire flute to create a flat surface for installation of a head of wall track to the underside of the metal fluted deck.

In yet another aspect, the present invention provides a building construction comprising said thermal insulating and sealing system.

In yet another aspect, the present invention provides a thermal insulating and sealing system which is suitable for acoustically insulating and sealing the head of wall area defined by a head of wall track installed parallel to the flute to an underside of a metal fluted deck.

BRIEF DESCRIPTION OF THE FIGURES

The subject matter of the present invention is further described in more detail by reference to the following figures.

DETAILED DESCRIPTION OF THE INVENTION

Figure 1:
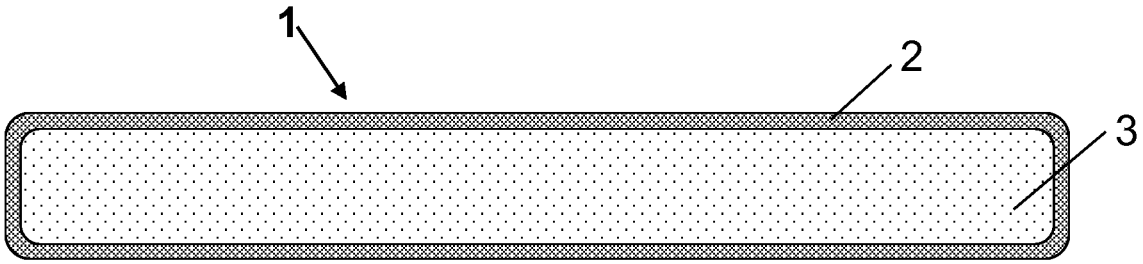
FIG. 1 shows a side cross-sectional view of an embodiment of the fire-resistant insulating and sealing element.

The following terms and definitions will be used in the context of the present invention:

As used in the context of present invention, the singular forms of "a" and "an" also include the respective plurals unless the context clearly dictates otherwise. Thus, the term "a" or "an" is intended to mean "one or more" or "at least one", unless indicated otherwise.

The term "metal deck construction" in context with the present invention refers to a head of a wall and a metal fluted deck comprising one or more flutes. In particular, the metal fluted deck has preferably a trapezoidally corrugated structure, but any other corrugated structure is possible.

The term "head of wall" in context with the present invention refers an area defined by a head of wall track including vertical studs and a dry wall, in particular a gypsum dry wall or board, affixed thereto.

The term "joint" in context with the present invention refers, in particular, to the area between the head of wall and the metal fluted deck.

The present invention pertains to a thermal insulating and sealing system and parts thereof for effectively thermally insulating and sealing of a head of wall joint within a building construction having a metal deck construction defined by a head of a wall and a metal fluted deck comprising one or more flutes, wherein the head of wall is defined by a head of wall track including vertical studs and a dry wall affixed thereto, and wherein the head of wall track is installed parallel to the flute to the underside of the metal fluted deck defining a head of wall joint extending between the top edge of the dry wall and the underside of the metal fluted deck. The thermal insulating and sealing system and parts thereof of the present invention are considered for the purpose of facilitating fire stopping and sound stopping of as well as movement within a head of wall area in those buildings utilizing a metal deck construction.

The thermal and acoustic insulating and sealing system and parts thereof according to the present invention are applicable for all types of metal deck constructions. Parts in particular include a fire-resistant insulating and sealing element for installation in a fluted roof deck construction.

The fire-resistant insulating and sealing element according to the present invention is for use in a metal deck construction defined by a head of a wall and a metal fluted deck comprising one or more flutes, wherein the head of wall is defined by a head of wall track including vertical studs for affixing a dry wall thereto, and wherein the head of wall track is installed parallel to the flute to an underside of the metal fluted deck.

The fire-resistant insulating and sealing element according to the present invention comprises at least one layer of a cover material and at least one layer of an insulating material. In particular, the at least one layer of the cover material is a flexible foil material, preferably a polymeric foil material, or a glass fiber material. The at least one layer of the insulating material is a formable thermally resistant and/or intumescent material. Preferably, the formable thermally resistant and/or intumescent material comprises a thermally resistant mineral wool material, rubber-like material or a foam. In a particular preferred embodiment, the foam is a foam based on polyurethane or an elastomeric interlaced foam based on synthetic rubber. Other such as open-cell or closed-cell foam-based materials, in particular foams such as a polyethylene foam, a polypropylene foam or a polyvinyl chloride foam are also suitable for the insulating material of the layer. The at least one layer of a cover material and at least one layer of an insulating material may be also from the same material.

The fire-resistant insulating and sealing element according to the present invention may further comprise at least one layer of a strengthening material. In particular, the at least one layer of a strengthening material is a fire-resistant material and/or ablative material selected from the group consisting of aluminum material, mineral material, ceramic fiber, glass fiber, metal material and gypsum material. In a particular preferred embodiment, the at least one layer of a strengthening material is a glass fiber material.

The fire-resistant insulating and sealing element according to the present invention further comprises fastening elements for fastening the fire-resistant insulating and sealing element to the underside of the metal fluted deck. The fastening elements are in form of straps made from a material selected from the group consisting of metal, reinforced fiber, and glass fiber. In a preferred embodiment, the fastening elements are in form of a thin rectangular metal strap. The fastening elements include attachment means for attaching the fastening elements together with the fire-resistant insulating and sealing element to the underside of the metal fluted deck. Such attachment means include, but are not limited to bolts, screws, tape, nails, brackets, and clips. Preferred attachment means include at least one adhesive means, pin means, tongue and groove means, screw means or barbed hook means. The at least one pin or screw means preferably extends through one or more fixing points of the strap and is attached to the underside of the metal fluted deck. However, other attachment devices may be used to attach the fire-resistant insulating and sealing element according to the present invention.

The fastening elements for fastening the fire-resistant insulating and sealing element to the underside of the metal fluted deck may also be pre-assembled to the fire-resistant insulating and sealing element enabling installation in one step on the construction site.

In a preferred embodiment of the fire-resistant insulating and sealing element additional sealing strips are positioned on the cover material for additional sealing of the head of wall area. These strips may be self-adhesive, which enable a simple temporarily fixation of the fire-resistant insulating and sealing element to the underside of the metal fluted deck. The sealing strips are located on the upper side of the fire-resistant insulating and sealing element and create a tight close between the fire-resistant insulating and sealing element and the underside of the metal fluted deck.

The fire-resistant insulating and sealing element according to the present invention is in form of a strap of preferably rectangular shape, but any other shape is also suitable. It can be delivered to the construction site in form of a roll, or in a rolled shape, which can then be easily cut into the appropriate length of the flutes.

The fire-resistant insulating and sealing element can be installed on site and hence is part of a modular or prefabricated metal deck design and forms part of the thermal insulating and sealing system. The fire-resistant insulating and sealing element of the present invention is also suitable for acoustically insulating and sealing the head of wall area defined by a head of wall track installed parallel to the flute to an underside of a metal fluted deck.

The thermal insulating and sealing system of the present invention for effectively thermally insulating and sealing of a head of wall joint within a building construction having a metal deck construction defined by a head of a wall and a metal fluted deck comprising one or more flutes, wherein the head of wall is defined by a head of wall track including vertical studs and a dry wall affixed thereto, and wherein the head of wall track is installed parallel to the flute to the underside of the metal fluted deck defining a head of wall joint extending between the top edge of the dry wall and the underside of the metal fluted deck, comprises a fire-resistant insulating and sealing element having at least one layer of a cover material, optionally at least one layer of a strengthening material, and at least one layer of an insulating material, wherein the at least one layer of a cover material is positioned in abutment with respect to the underside of the metal fluted deck spanning across the entire flute to create a flat surface for installation of a head of wall track to the underside of the metal fluted deck; and optionally fastening elements for fastening the fire-resistant insulating and sealing element to the underside of the metal fluted deck.

The fire-resistant insulating and sealing element is fastened by fastening elements in form of straps, preferably in form of a thin rectangular metal strap, arranged perpendicular to the flute to the underside of the metal fluted deck using attachment means for attaching the fastening elements together with the fire-resistant insulating and sealing element to the underside of the metal fluted deck. Such attachment means include, but are not limited to bolts, screws, tape, nails, brackets, and clips. Preferred attachment means include at least one adhesive means, pin means, tongue and groove means, screw means or barbed hook means. The at least one pin or screw means preferably extends through one or more fixing points of the strap and is attached to the underside of the metal fluted deck. However, other attachment devices may be used to attach the fire-resistant insulating and sealing element according to the present invention. The fastening elements for fastening the fire-resistant insulating and sealing element to the underside of the metal fluted deck may also be pre-assembled to the fire-resistant insulating and sealing element enabling installation in one step on the construction site.

By positioning the fire-resistant insulating and sealing element to the underside of the metal fluted deck, a flat surface is created and the construction strength is enhanced during a fire due to the additional stabilization of the head of wall area and by avoiding a persistent joint. Additional sealing can enhance maintaining sealing of the head of wall area. It should be appreciated that the dimensions of the fire-resistant insulating and sealing element can be varied significantly to accommodate various configurations of different flutes and shapes of a fluted roof deck construction in order to accommodate and effective thermally insulate and seal any such fluted roof deck construction. The gap between the top edge of the dry wall gypsum boards and the underside of the metal fluted deck is additional sealed with mineral wool according to known standards.

One aspect of the present invention provides for a fluted roof deck comprising a fire-resistant insulating and sealing element for covering at least one of the flutes comprised in a metal fluted deck to create a flat surface for installation of a head of wall track to the underside of the metal fluted deck, wherein the fire-resistant insulating and sealing element having at least one layer of a cover material, optionally at least one layer of a strengthening material, and at least one layer of an insulating material is positioned in abutment with respect to the underside of the metal fluted deck spanning across the entire flute to create a flat surface for installation of a head of wall track to the underside of the metal fluted deck.

The thermal insulating and sealing system according to the present invention is preferably for use with a building construction having a metal deck construction defined by a head of a wall and a metal fluted deck comprising one or more flutes, wherein the head of wall is defined by a head of wall track including vertical studs for affixing a dry wall thereto, and wherein the head of wall track is installed parallel to the flute to an underside of the metal fluted deck.

In particular, the building construction comprises a thermally insulating and sealing system for effectively thermally insulating and sealing system for effectively thermally and acoustically insulating and sealing of a head of wall joint, wherein the thermal insulating and sealing system comprises the fire-resistant insulating and sealing element of the present invention.

The fire-resistant insulating and sealing element as well as the thermal insulating and sealing system according to the present invention is also for acoustically insulating and sealing of a head of wall joint within a building construction having a metal deck construction defined by a head of a wall and a metal fluted deck comprising one or more flutes, wherein the head of wall is defined by a head of wall track including vertical studs and a dry wall affixed thereto, and wherein the head of wall track is installed parallel to the flute to the underside of the metal fluted deck defining a head of wall joint extending between the top edge of the dry wall and the underside of the metal fluted deck. The material used for insulating may be of a sound resistant and/or air tight material, such as a mineral wool material, rubber-like material or a foam, such for example an elastomeric interlaced foam based on synthetic rubber, a polyethylene foam, a polyurethane foam, a polypropylene foam or a polyvinyl chloride foam.

While the invention is particularly pointed out and distinctly described herein, preferred embodiments are set forth in the following detailed description which may be best understood when read in connection with the accompanying drawings.

Figure 2:
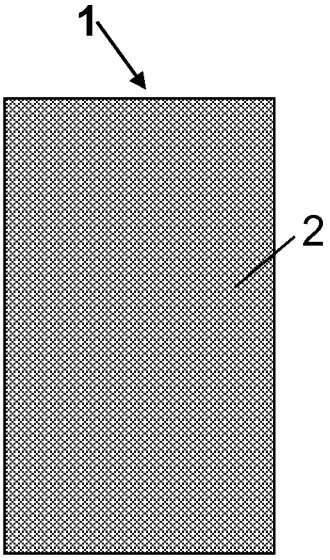
FIG. 2 shows a top view of the embodiment of the fire-resistant insulating and sealing element as shown in FIG. 1.
Figure 3:
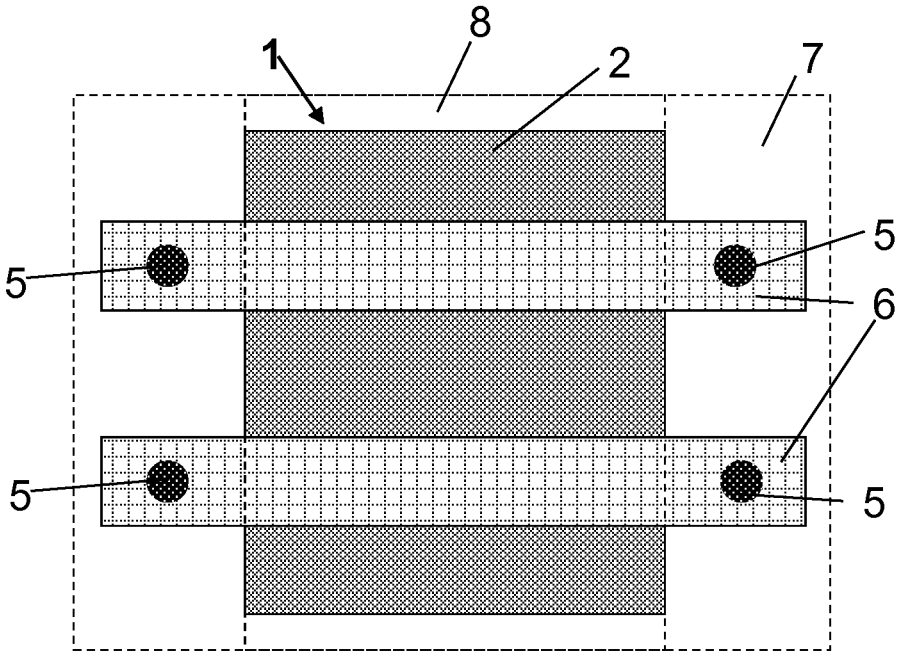
FIG. 3 shows a bottom view of the embodiment of the fire-resistant insulating and sealing element as shown in FIGS. 1 and 2, fixed with metal straps to the underside of a flute.
Figure 4:
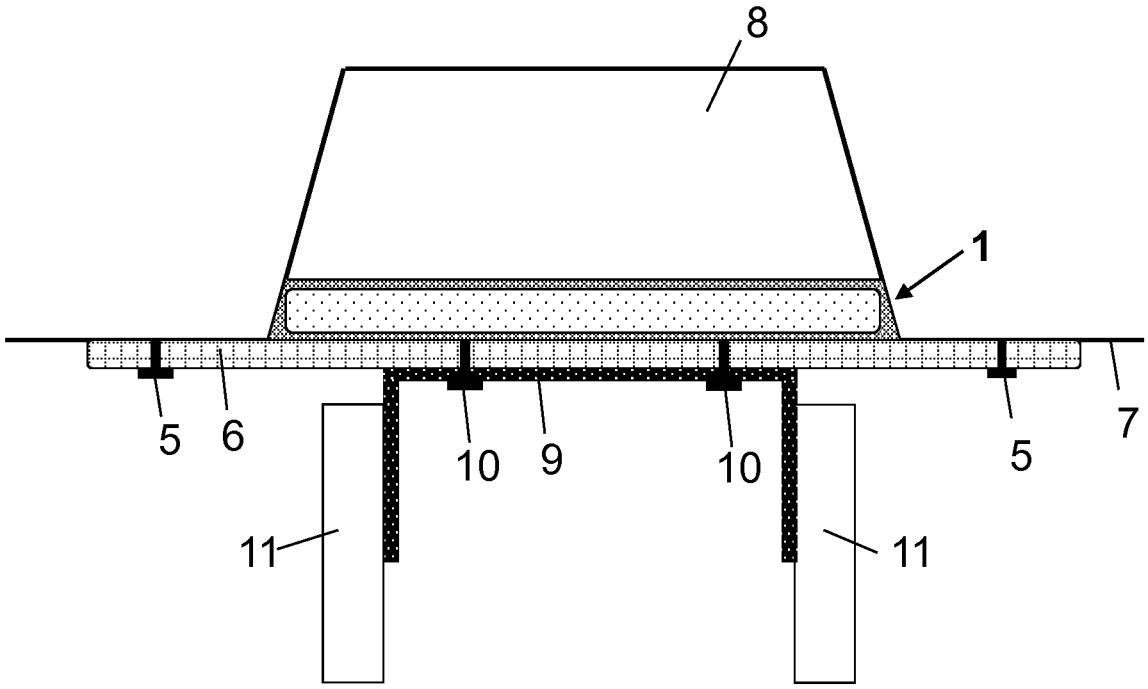
FIG. 4 shows a side cross-sectional view of a thermal insulating and sealing system comprising the fire-resistant insulating and sealing element as shown in FIGS. 1 and 2.

In FIG. 1 is shown a side cross-sectional view of an embodiment of the fire-resistant insulating and sealing element according to the present invention. The fire-resistant insulating and sealing element 1 comprises one layer of a cover material 2, such as a flexible polyethylene foil material, and one layer of an insulating material 3, such as a foam material based on polyurethane. The cover material 2 fully encases the layer of insulating material 3. The fire-resistant insulating and sealing element 1 is in form of a substantially flat strap of rectangular shape. A top view of the fire-resistant insulating and sealing element 1 is shown in FIG. 2. FIG. 3 shows a bottom view of the fire-resistant insulating and sealing element 1 as shown in FIGS. 1 and 2, fixed with attachment means 5, such as screws, and fastening elements 6, such as metal straps, to the underside 7 of a flute 8 of a metal fluted deck creating a flat surface for installation of a head of wall track to the underside 7 of the metal fluted deck. FIG. 4 shows a side cross-sectional view of the thermal insulating and sealing system according to the present invention comprising the fire-resistant insulating and sealing element 1 as shown in FIGS. 1 and 2. The fire-resistant insulating and sealing element 1 covers one of the flutes 8 comprised in a metal fluted deck to create a flat surface for installation of a head of wall track 9 to the underside 7 of the metal fluted deck. The fire-resistant insulating and sealing element 1 is positioned in abutment with respect to the underside 7 of the metal fluted deck spanning across the entire flute 8 to create a flat surface for installation of a head of wall track 9 to the underside 7 of the metal fluted deck. The head of wall track 9, also known as ceiling runner, has a U-shape, and is fixed using screws 10 to the underside of the metal straps 6 holding the fire-resistant insulating and sealing element 1 in place within the flute 8. The dry wall gypsum boards 11 are fixed on the vertical studs located on the ceiling runner 9 to create an insulated and sealed metal deck construction having a head of wall track 9 installed parallel to the flute 8. The gap between the top edge of the dry wall gypsum boards 11 and the underside 7 of the metal fluted deck is sealed with mineral wool (not shown).

Figure 5:
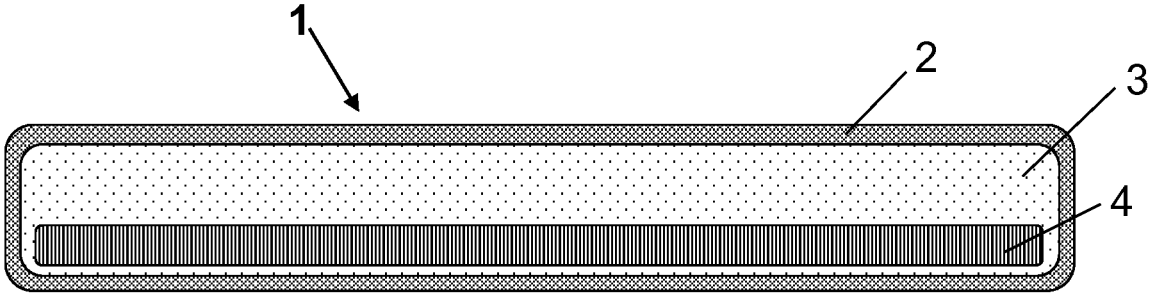
FIG. 5 shows a side cross-sectional view of another embodiment of the fire-resistant insulating and sealing element.
Figure 6:
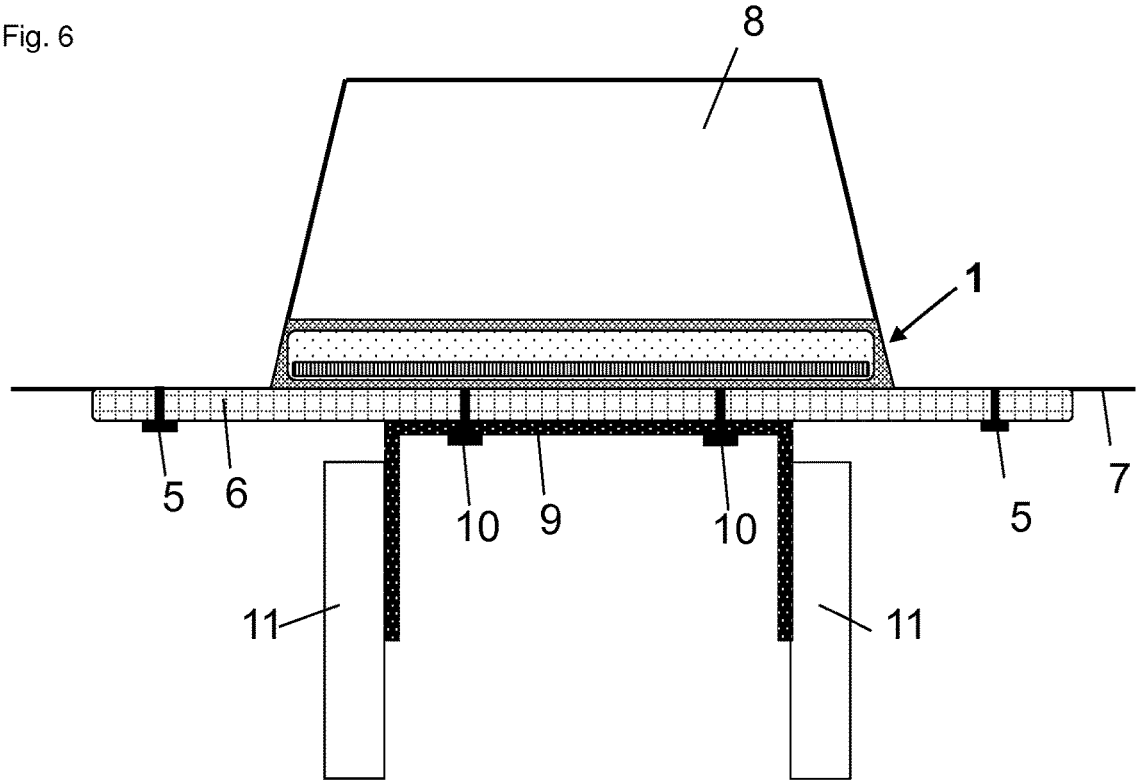
FIG. 6 shows a side cross-sectional view of a thermal insulating and sealing system comprising the fire-resistant insulating and sealing element as shown in FIG. 5.

In FIG. 5 is shown a side cross-sectional view of another embodiment of the fire-resistant insulating and sealing element according to the present invention. The fire-resistant insulating and sealing element 1 is similar to the one shown in FIGS. 1 to 4, but further comprises a layer of a strengthening material 4, such as a glass fiber material, positioned within the layer of insulating material 3. The top view and the bottom view of the fire-resistant insulating and sealing element 1 of this embodiment correspond to FIGS. 2 and 3, respectively. FIG. 6 shows a side cross-sectional view of the thermal insulating and sealing system according to the present invention comprising the fire-resistant insulating and sealing element 1 as shown in FIG. 5. The gap between the top edge of the dry wall gypsum boards 11 and the underside 7 of the metal fluted deck is sealed with mineral wool (not shown). The other remaining elements of the thermal insulating and sealing system are the same as described for FIG. 4.

Figure 7:
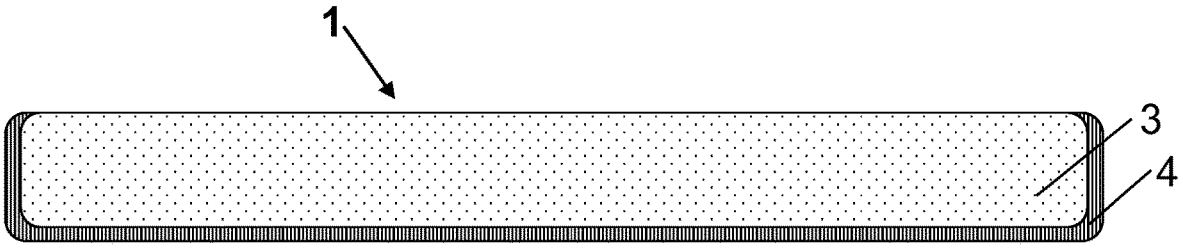
FIG. 7 shows a side cross-sectional view of another embodiment of the fire-resistant insulating and sealing element.
Figure 8:
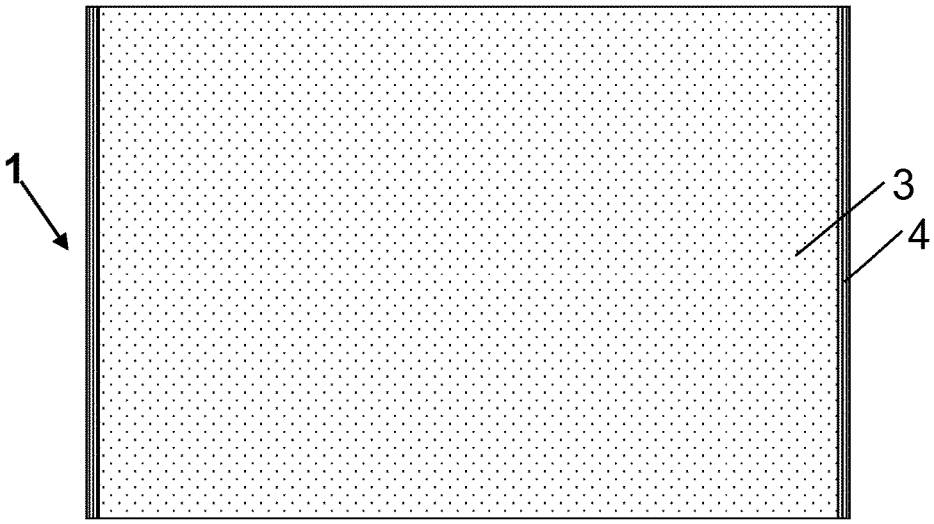
FIG. 8 shows a top view of the embodiment of the fire-resistant insulating and sealing element as shown in FIG. 7.
Figure 9:
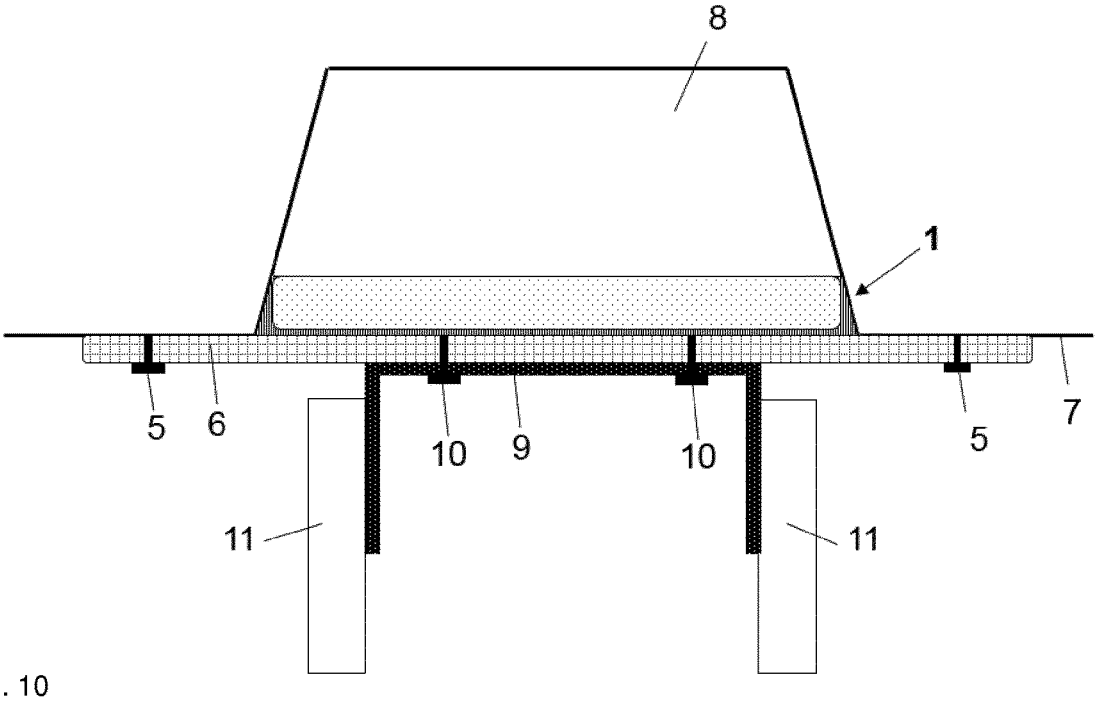
FIG. 9 shows a side cross-sectional view of a thermal insulating and sealing system comprising the fire-resistant insulating and sealing element as shown in FIGS. 7 and 8.

FIG. 7 shows a side cross-sectional view of another embodiment of the fire-resistant insulating and sealing element according to the present invention. The fire-resistant insulating and sealing element 1 is similar to the one shown in FIGS. 5 and 6, but the layer of the strengthening material 4 encases the layer of insulating material 3 at least on three sides. A top view of the fire-resistant insulating and sealing element 1 is shown in FIG. 8. A layer of a cover material may be positioned on the outside of the layer of the strengthening material 4 (not shown in FIGS. 7 and 8). The bottom view of the fire-resistant insulating and sealing element 1 of this embodiment including a layer of a cover material 4 corresponds to FIG. 3. FIG. 9 shows a side cross-sectional view of the thermal insulating and sealing system according to the present invention comprising the fire-resistant insulating and sealing element 1 as shown in FIGS. 7 and 8. The gap between the top edge of the dry wall gypsum boards 11 and the underside 7 of the metal fluted deck is sealed with mineral wool (not shown). The other remaining elements of the thermal insulating and sealing system are the same as described for FIG. 4 or 6.

Figure 10:
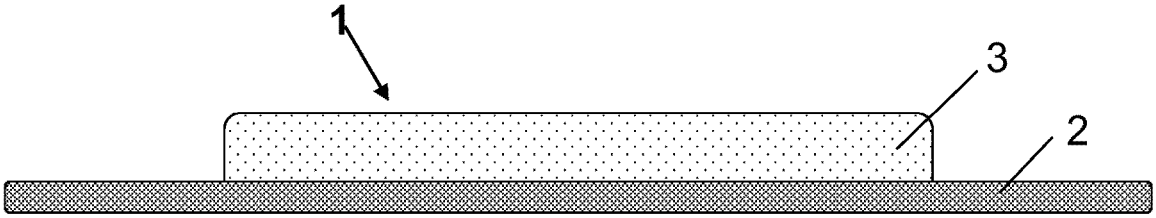
FIG. 10 shows a side cross-sectional view of another embodiment of the fire-resistant insulating and sealing element.
Figure 11:
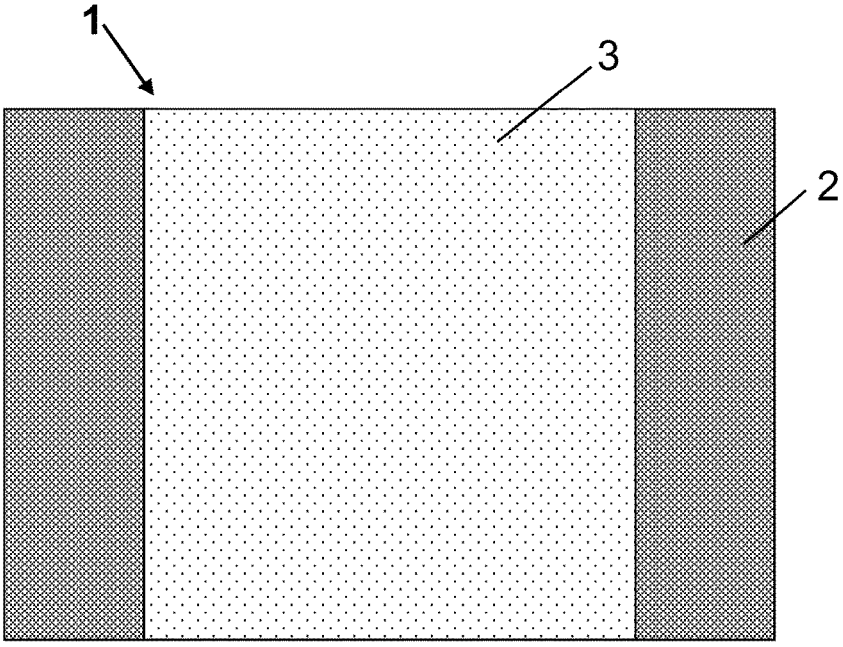
FIG. 11 shows a top view of the embodiment of the fire-resistant insulating and sealing element as shown in FIG. 10.
Figure 12:
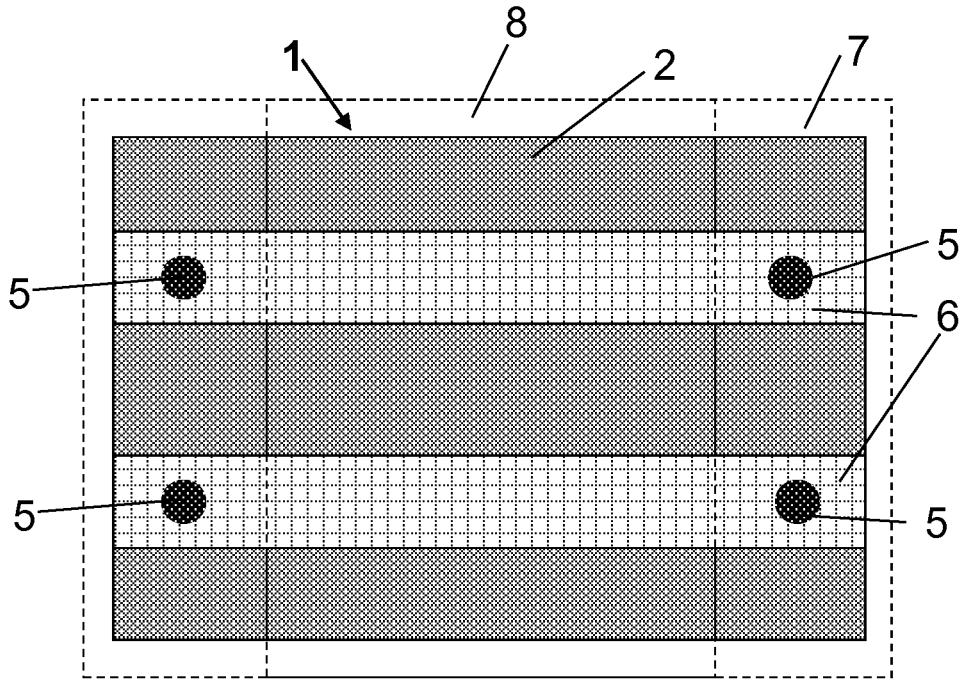
FIG. 12 shows a bottom view of the embodiment of the fire-resistant insulating and sealing element as shown in FIGS. 10 and 11, fixed with metal straps to the underside of a flute.
Figure 13:
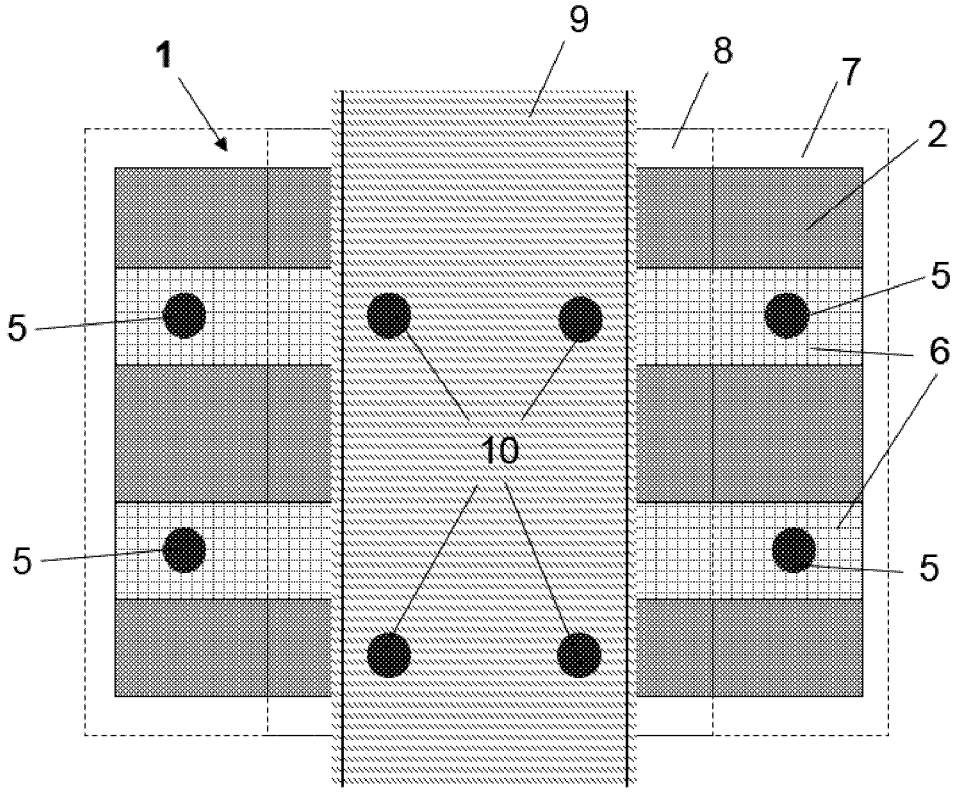
FIG. 13 shows a bottom view of a thermal insulating and sealing system comprising the fire-resistant insulating and sealing element as shown in FIGS. 10 and 11.
Figure 14:
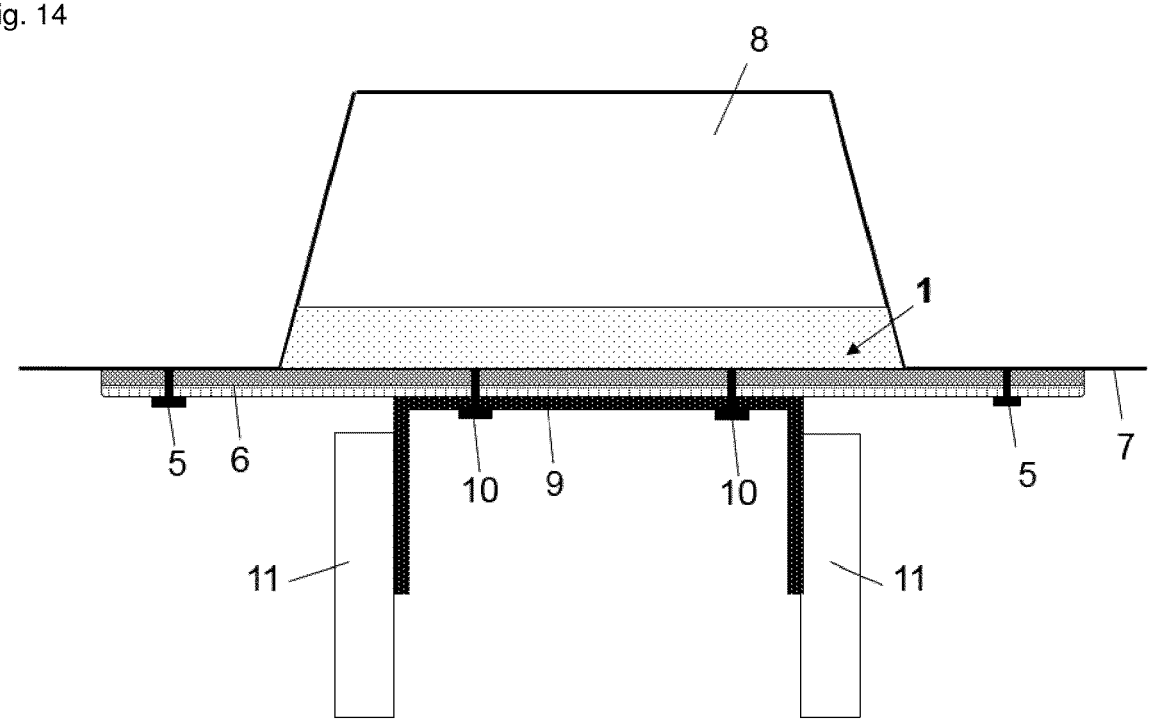
FIG. 14 shows a side cross-sectional view of a thermal insulating and sealing system comprising the fire-resistant insulating and sealing element as shown in FIGS. 10 and 11.

In FIG. 10 is shown a side cross-sectional view of another embodiment of the fire-resistant insulating and sealing element according to the present invention. The fire-resistant insulating and sealing element 1 comprises one layer of a cover material 2, such as a polyethylene foil material or a glass fiber material, and one layer of an insulating material 3, such as a foam material based on polyurethane. The cover material 2 forms the base for the insulating material 3 and may be strengthened by a strengthening material (not shown). The fire-resistant insulating and sealing element 1 is in form of a substantially flat strap of rectangular shape. A top view of the fire-resistant insulating and sealing element 1 is shown in FIG. 11. FIG. 12 shows a bottom view of the fire-resistant insulating and sealing element 1 as shown in FIGS. 10 and 11, fixed with attachment means 5, such as screws, and fastening elements 6, such as metal straps, to the underside 7 of a flute 8 of a metal fluted deck creating a flat surface for installation of a head of wall track to the underside 7 of the metal fluted deck. The insulating material 3 rests within the flute 8. FIG. 13 shows again a bottom view of the thermal insulating and sealing system as shown in FIG. 12, wherein the head of wall track 9 is fixed using screws 10 to the underside of the metal straps 6 holding the fire-resistant insulating and sealing element 1 in place within and across the flute 8. FIG. 14 shows a side cross-sectional view of the thermal insulating and sealing system according to the present invention comprising the fire-resistant insulating and sealing element 1 as shown in FIGS. 10 and 11. The fire-resistant insulating and sealing element 1 covers one of the flutes 8 comprised in a metal fluted deck to create a flat surface for installation of a head of wall track 9 to the underside 7 of the metal fluted deck. The fire-resistant insulating and sealing element 1 is positioned in abutment with respect to the underside 7 of the metal fluted deck spanning across the entire flute 8 to create a flat surface for installation of a head of wall track 9 to the underside 7 of the metal fluted deck. The insulating material 3 rests within the flute 8. The head of wall track 9 is fixed using screws 10 to the underside of the metal straps 6 holding the fire-resistant insulating and sealing element 1 in place within the flute 8. The dry wall gypsum boards 11 are fixed on the vertical studs located on the ceiling runner 9 to create an insulated and sealed metal deck construction having a head of wall track 9 installed parallel to the flute 8. The gap between the top edge of the dry wall gypsum boards 11 and the underside 7 of the metal fluted deck is sealed with mineral wool (not shown).

Figure 15:
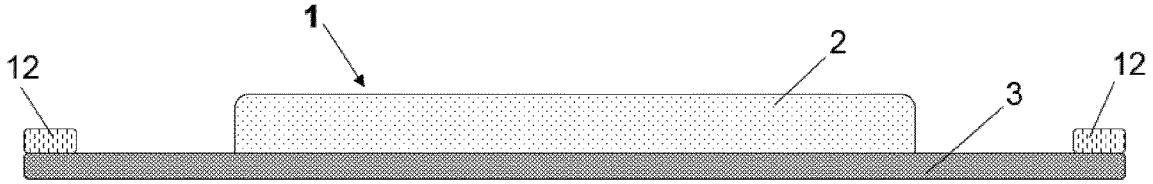
FIG. 15 shows a side cross-sectional view of another embodiment of the fire-resistant insulating and sealing element.
Figure 16:
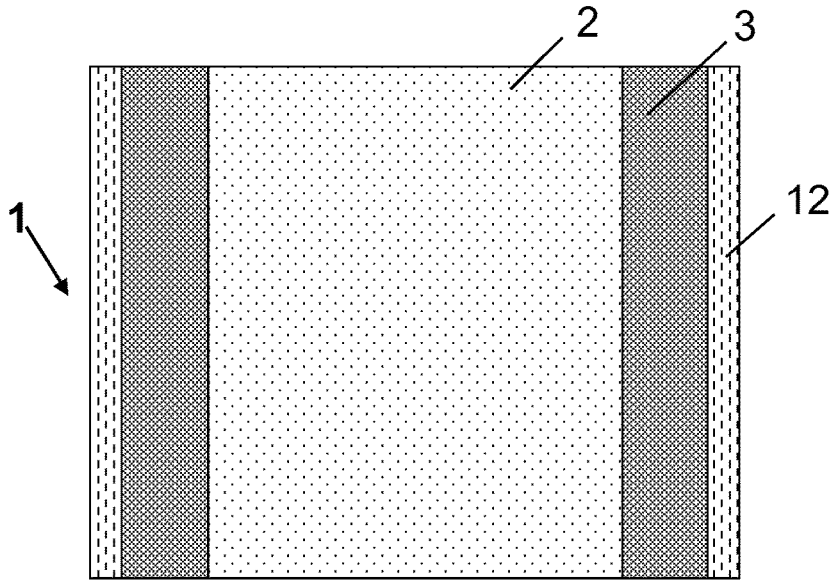
FIG. 16 shows a top view of the embodiment of the fire-resistant insulating and sealing element as shown in FIG. 15.
Figure 17:
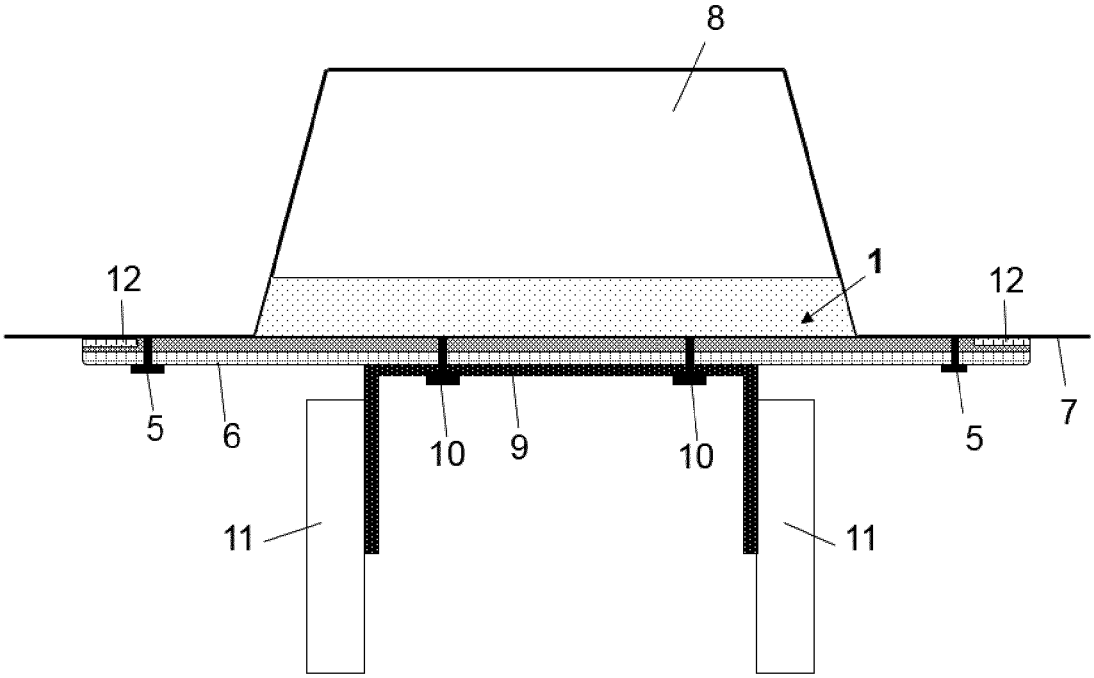
FIG. 17 shows a side cross-sectional view of a thermal insulating and sealing system comprising the fire-resistant insulating and sealing element as shown in FIGS. 15 and 16.

In FIG. 15 is shown a side cross-sectional view of another embodiment of the fire-resistant insulating and sealing element according to the present invention. The fire-resistant insulating and sealing element 1 is similar to the one shown in FIGS. 10 and 11, but comprises additional sealing strips 12 positioned on the cover material for additional sealing of the head of wall area. These strips may be self-adhesive, which enable a simple temporarily fixation of the fire-resistant insulating and sealing element to the underside of the metal fluted deck. The sealing strips 12 are located on the upper side of the fire-resistant insulating and sealing element as shown in FIG. 15. A top view of the fire-resistant insulating and sealing element 1 is shown in FIG. 16. FIG. 17 shows a side cross-sectional view of the thermal insulating and sealing system according to the present invention comprising the fire-resistant insulating and sealing element 1 as shown in FIGS. 15 and 16 similar to the one shown in FIG. 14. The gap between the top edge of the dry wall gypsum boards 11 and the underside 7 of the metal fluted deck is sealed with mineral wool (not shown). The other remaining elements of the thermal insulating and sealing system are the same as described for FIG. 14.

It should be appreciated that these embodiments of the present invention will work with many different types of insulating, cover and strengthening materials used for the fire-resistant insulating and sealing element and with many different types and shapes of the fire-resistant insulating and sealing element as long as the materials and form are suitable for maintaining the insulation and seal of a head of wall joint within a building construction having a metal deck construction defined by a head of a wall and a metal fluted deck comprising one or more flutes, wherein the head of wall is defined by a head of wall track including vertical studs and a dry wall affixed thereto, and wherein the head of wall track is installed parallel to the flute to the underside of the metal fluted deck.

It has been shown, that the fire-resistant insulating and sealing element of the present invention can be fast and simple installed in a fluted metal deck construction. It can be delivered to the construction site in form of a roll, or in a rolled shape, which can then be easily cut into the appropriate length of the flutes. fire-resistant insulating and sealing element creates a flat surface for installation of a head of wall track to the underside of the metal fluted deck and parallel to the flute.

It is also possible to combine the fire-resistant insulating and sealing element of the present invention with other pre-manufactured insulating and sealing elements, such as CFS-TTS firestop top track seal (Hilti, USA) used for non-fluted building constructions.

Furthermore, the fire-resistant insulating and sealing element within the thermal insulating and sealing system can be installed independent from the substrate as no particular adhesion requirements of the used materials must be met. Its-pre-fabricated form ensures that enough material is installed to guarantee fire-stopping at the head of wall area.

Further, the thermal insulating and sealing system is not limited to a specific flute dimension, in particular the flute height; on face installation in the head of wall area is possible. The thermal insulating and sealing system provides for movement and tolerance compensation which leads to improved fire-resistance. It has been shown that the thermal insulating and sealing system is able to compensate dimensional tolerances of the deck as well as wall and to allow movement between the deck and the wall element caused by load or temperature.

Finally, it has been shown that the fire-resistant insulating and sealing element and the thermal insulating and sealing system according to the present invention is also for acoustically insulating and sealing of a head of wall area on a fluted roof deck construction, in particular the thermal insulating and sealing system shows improved sound-resistant properties.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

The invention claimed is:

1. A fire-resistant insulating and/or sealing element comprising:

one or more flutes, wherein the fire-resistant insulating and/or sealing element is suitable for use in a metal deck construction defined by a head of a wall and a metal fluted deck, wherein the head of the wall is defined by a head of a wall track comprising vertical studs for affixing a dry wall thereto, and wherein the head of the wall track is installed parallel to the flute to an underside of the metal fluted deck, wherein the fire-resistant insulating and/or sealing element comprises a cover material and at least one layer of an insulating material, and wherein the cover material comprises a continuous single layer that fully encases the at least one layer of insulation material.

2. The fire-resistant insulating and/or sealing element according to claim 1, wherein the cover material is a flexible foil material.

3. The fire-resistant insulating and/or sealing element according to claim 1, wherein the at least one layer of the insulating material is a formable thermally resistant and/or intumescent material.

4. The fire-resistant insulating and/or sealing element according to claim 3, wherein the formable thermally resistant and/or intumescent material comprises at least one material selected from the group consisting of a thermally resistant mineral wool material, a rubber-like material and a foam.

5. The fire-resistant insulating and/or sealing element according to claim 4, comprising the foam and wherein the foam is a foam based on polyurethane or an elastomeric interlaced foam based on synthetic rubber.

6. The fire-resistant insulating and/or sealing element according to claim 1, further comprising at least one layer of a strengthening material.

7. The fire-resistant insulating and/or sealing element according to claim 6, wherein the at least one layer of a strengthening material is at least one fire-resistant material and/or ablative material selected from the group consisting of aluminum material, mineral material, ceramic fiber, glass fiber, metal material and gypsum material.

8. The fire-resistant insulating and/or sealing element according to claim 6, wherein the at least one layer of a strengthening material is a glass fiber material or a gypsum material.

9. The fire-resistant insulating and/or sealing element according to claim 1, further comprising fastening elements for fastening the fire-resistant insulating and/or sealing element to the underside of the metal fluted deck.

10. The fire-resistant insulating and/or sealing element according to claim 9, wherein the fastening elements are in a form of straps made from a material selected from the group consisting of metal, reinforced fiber, and glass fiber.

11. The fire-resistant insulating and/or sealing element according to claim 1, wherein the fire-resistant insulating and/or sealing element is a fire and sound resistant insulating and sealing element in the form of a strap.

12. A building construction having a metal deck construction defined by a head of a wall and a metal fluted deck, comprising:

one or more flutes, wherein the head of the wall is defined by a head of a wall track comprising vertical studs for affixing a dry wall thereto, and wherein the head of the wall track is installed parallel to the flute to an underside of the metal fluted deck, comprising a thermal insulating and/or sealing system for effectively thermally and/or acoustically insulating and sealing of a head of wall joint, wherein the thermal insulating and/or sealing system comprises a fire-resistant insulating and/or sealing element according to claim 1.

13. The fire-resistant insulating and/or sealing element according to claim 1, wherein the cover material does not have a corrugated shape.

14. A thermal insulating and/or sealing system, comprising:

one or more flutes, wherein the thermal insulating and/or sealing system effectively thermally insulates and seals a head of a wall joint within a building construction comprising a metal deck construction defined by a head of a wall and a metal fluted deck, wherein the head of the wall is defined by a head of a wall track comprising vertical studs and a dry wall affixed thereto, and wherein the head of the wall track is installed parallel to the flute to the underside of the metal fluted deck defining a head of a wall joint extending between the top edge of the dry wall and the underside of the metal fluted deck, further comprising:

a fire-resistant insulating and/or sealing element comprising a cover material, and at least one layer of an insulating material, wherein the cover material is positioned in abutment with respect to the underside of the metal fluted deck spanning across the entire flute to create a flat surface for installation of a head of wall track to the underside of the metal fluted deck; and optionally, a fastening element for fastening the fire-resistant insulating and/or sealing element to the underside of the metal fluted deck wherein the cover material comprises a continuous single layer that fully encases the at least one layer of insulation material.

15. The thermal insulating and/or sealing system according to claim 14, wherein the fire-resistant insulating and/or sealing element is fastened by fastening elements in form of straps arranged perpendicular to the flute to the underside of the metal fluted deck.

16. The thermal insulating and/or sealing system according to claim 14, further comprising a fastening element for fastening the fire-resistant insulating and/or sealing element to the underside of the metal fluted deck.

17. A fluted roof deck, comprising:

a fire-resistant insulating and/or sealing element for covering at least one of the flutes positioned in a metal fluted deck to create a flat surface for installing a head of a wall track to the underside of the metal fluted deck, wherein the fire-resistant insulating and/or sealing element comprising a cover material, and at least one layer of an insulating material is positioned in abutment with respect to the underside of the metal fluted deck spanning across the entire flute to create a flat surface for installing the head of the wall track to the underside of the metal fluted deck, wherein the cover material comprises a continuous single layer that fully encases the at least one layer of insulation material.

18. The fluted roof deck according to claim 17, further comprising at least one layer of a strengthening material.

19. A fire-resistant insulating and/or sealing element for use in a metal deck construction defined by a head of a wall and a metal fluted deck having one or more flutes, wherein the head of the wall is defined by a head of a wall track including vertical studs for affixing a dry wall thereto, and wherein the head of the wall track is installed parallel to the flute to an underside of the metal fluted deck, wherein the fire-resistant insulating and/or sealing element comprises a cover material and at least one layer of an insulating material, wherein the cover material comprises a continuous single layer that fully encases the layer of insulation material, wherein the the cover material is a flexible foil material, and wherein the at least one layer of the insulating material is a formable thermally resistant and/or intumescent material.

20. The fire-resistant insulating and/or sealing element according to claim 19, wherein the cover material is polymeric foil material or a glass fiber, and wherein the formable thermally resistant and/or intumescent material comprises at least one material selected from the group consisting of a thermally resistant mineral wool material, a rubber-like material, and a foam.

* * * * *